United States Patent [19]

Hughes

[11] 4,084,688

[45] Apr. 18, 1978

[54] BOTTLE CARRIER

[75] Inventor: Robert G. Hughes, Rexdale, Canada

[73] Assignee: Continental Can Company of Canada Ltd., Toronto, Canada

[21] Appl. No.: 737,400

[22] Filed: Nov. 1, 1976

[51] Int. Cl.[2] ..... B65D 85/40

[52] U.S. Cl. ..... 206/188; 206/180; 206/193; 229/52 BC; 229/28 BC

[58] Field of Search ..... 206/170–193; 229/28 BC, 52 BC, 39 R

[56] References Cited

U.S. PATENT DOCUMENTS

| | | | |
|---|---|---|---|
| 2,069,997 | 2/1937 | Carr | 206/193 |
| 2,606,711 | 8/1952 | Forrer | 229/52 BC |
| 2,685,999 | 8/1954 | Forrer | 229/52 BC |

FOREIGN PATENT DOCUMENTS

| | | | |
|---|---|---|---|
| 565,469 | 11/1958 | Canada | 206/193 |
| 1,090,635 | 10/1954 | France | 206/193 |

*Primary Examiner*—William Price
*Assistant Examiner*—Douglas B. Farrow
*Attorney, Agent, or Firm*—Diller, Brown, Ramik & Wight

[57] ABSTRACT

A carrier made from a one-piece blank comprising when erected a pair of cells with each cell including an end wall. A pair of opposed side walls and a dividing wall opposed to said end wall including handle means therein. Each dividing wall is adjacent and coextensive with a respective dividing wall of the other cell. The bottom walls of each cell are formed by a continuous panel extending from the respective end walls of each cell and a rectangular flap is connected to the bottom edge of at least one side wall in each cell to substantially overlay the bottom wall portion of the cell thereby reinforcing the bottom wall.

7 Claims, 5 Drawing Figures

68
18
A
12
B
60
54
14
16
56
84
10
40
36
68
38
44
42
46
46
56
54
48
50
38
68
64
A
10
B
60
14
56
4
5
54
5
50
4
84
60
18
68
38
54
36
82
22
26
46
80
64
56

BOTTLE CARRIER

BACKGROUND OF THE INVENTION

1. Field of the Invention

The present invention relates to carriers and more particularly to foldable paperboard carriers for beverage containers and the like.

2. Description of the Prior Art

It is well known to provide a carrier of the type made from a single blank with dividing panels to separate the carrier into two cells and a single integrated handle provided in the dividing panel. Similarly, it is well known to provide such a carrier which can be manufactured and glued and shipped to a bottling plant in a flat folded condition with the feature that the container can be erected by applying pressure on two opposite edges of the carrier causing the bottom walls to fold down and retain the carrier in an erected condition. The type of carrier is described, for instance, in U.S. Pat. No. 2,755,961, Ringler, 1956; U.S. Pat. No. 2,942,756, Collura et al, 1960; as well as in U.S. Pat. No. 2,881,946, Bosrock et al, 1959.

All of these cartons, however, present in an erected condition, a segmented interlocked bottom wall which is no more than one ply thick in certain areas. The support strength, therefore, of the bottom walls in the above-mentioned patent is dependent on the glue strength and/or interlocking strength of the various component flaps making up the bottom wall. In addition, in the case of beverage bottles, liquid can often be found to leak down the sides of the bottles on to the carton. The liquid may be simply from condensation forming on the outside of the glass bottles, but the bottom walls must be made to support the beverage containers even if they are wet.

SUMMARY OF THE INVENTION

It is the aim of the present invention to provide an improved carrier having two cells for carrying two beverage containers such as bottles whereby the construction of the carrier is simplified and greater economy of paperboard is found. It is a further aim of the present invention to provide an improved bottom wall construction with increased strength compared to presently available carrier bottom walls.

A construction in accordance with the present invention includes a carrier made from a one-piece blank comprising, when erected, a pair of cells with each cell including an end wall, a pair of opposed side walls and a dividing wall opposed to said end wall including handle means therein, each dividing wall being adjacent a respective dividing wall of the other cell, the bottom walls formed by a continuous panel extending from the respective end walls of each cell and a rectangular flap connected to the bottom edge of at least one side wall in each cell to substantially overlay the bottom wall portion of the cell, thereby reinforcing said bottom wall.

The one-piece blank in accordance with the present invention includes a first end wall forming panel defined by a pair of parallel fold lines connected to a pair of first side walls forming panels and at least one of the side wall panels connected to a first rectangular dividing panel including handle means cut out therein, the end wall forming panel being connected to a rectangular bottom forming panel along a transverse edge thereof. The bottom forming panel is in turn connected to a second end panel similar to the first end panel and the second end panel is connected along parallel fold lines to respective second side panels and at least one of the side panels is connected to a further rectangular panel having handle means therein for cooperating with the first rectangular panel having handle means for forming the dividing walls between the cells and a rectangular panel hingedly connected to at least one of each opposed side panels along the transverse edge thereof and said rectangular panel is adapted to overlay the bottom wall.

BRIEF DESCRIPTION OF THE DRAWINGS

The invention will now be described in more detail with reference to the accompanying drawings, in which.

DETAILED DESCRIPTION OF THE DRAWINGS

Figure 1:
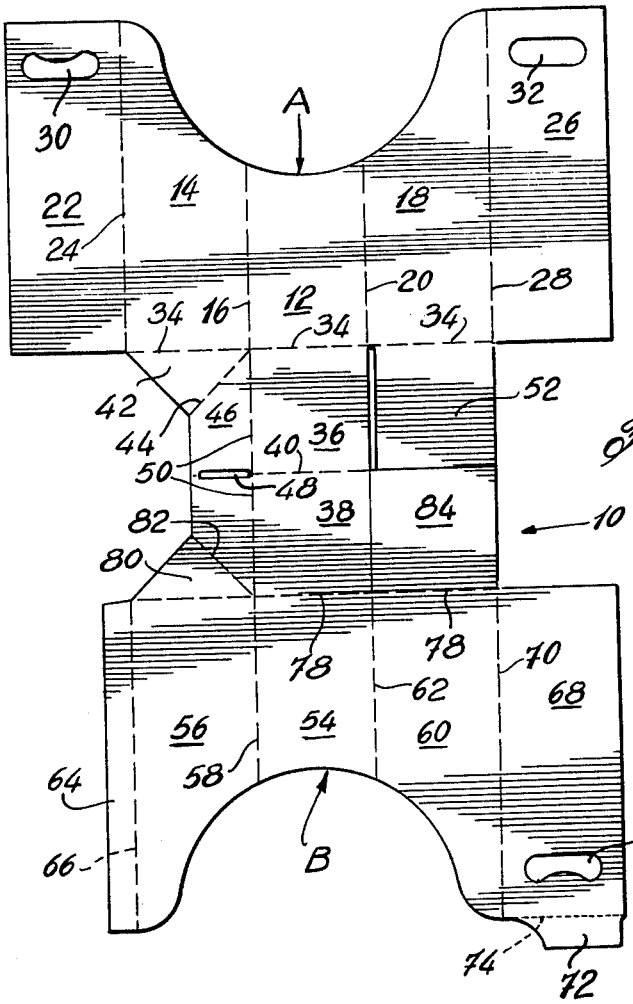
FIG. 1 is a top plan view of a blank for forming the carrier of the present invention.

Referring now to the drawings, and especially to FIG. 1, there is shown a one-piece blank having a first group of panels for forming a compartment or cell "A" in a second group of panels for forming the cell "B" of a carrier 10. End panel 12 is provided and a pair of side panels 14 and 18 are hinged on either side of end panel 12 along fold lines 16 and 20 respectively. Divider panels 22 and 26 are in turn connected to each of side panels 14 and 18 along fold lines 24 and 28 respectively. Each divider panel 22 and 26 is provided with handle openings 30 and 32 as shown.

A transverse fold line 34 is common to panels 12, 14 and 18. A square bottom panel 36 is connected to end panel 12 along the common fold line 34. A second square bottom panel 38 is connected to the bottom panel 36 along the fold line 40.

Joined to the side panel 14 along the fold line 34 is a triangular-shaped web-type flap 42 which in turn is connected to a trapezoidal-shaped panel 46 along the fold line 44. Panel 46 is provided with an elongated slot 48 centrally thereof.

A square flap 52 is joined to the side panel 18 along the common fold line 34 is meant to overlay the bottom of the cell "A".

End panel 54 is hinged to the bottom wall panel 38 along a common fold line 78. A side panel 56 and a side panel 60 are connected to end panel 54 and are hinged about the fold lines 58 and 62 respectively. Side panel 56 is provided with a glue flap 64 as shown. A dividing panel 68 is connected to the side panel 60 along the fold line 70. The dividing panel 68 includes an opening for a handle 76 and a glue flap 72 hinged about a fold line 74.

A triangular flap 80 is connected to the panel 56 along the common fold line 78 and is also hinged along one edge thereof to the trapezoidal flap 46 along the fold line 82. A square flap 84 is hinged along the fold line 78 to the side panel 60 to eventually overlay the bottom cell wall 38.

Figure 5:
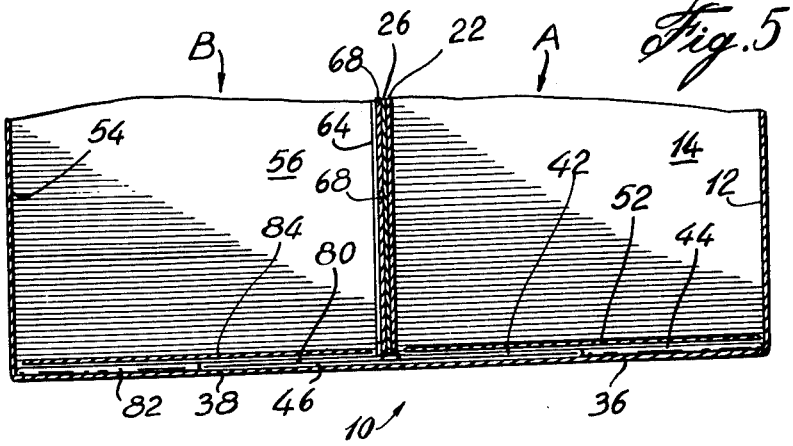
FIG. 5 is a vertical fragmentary cross-section taken along lines V—V of FIG. 3.
Figures 2, 3, 4:
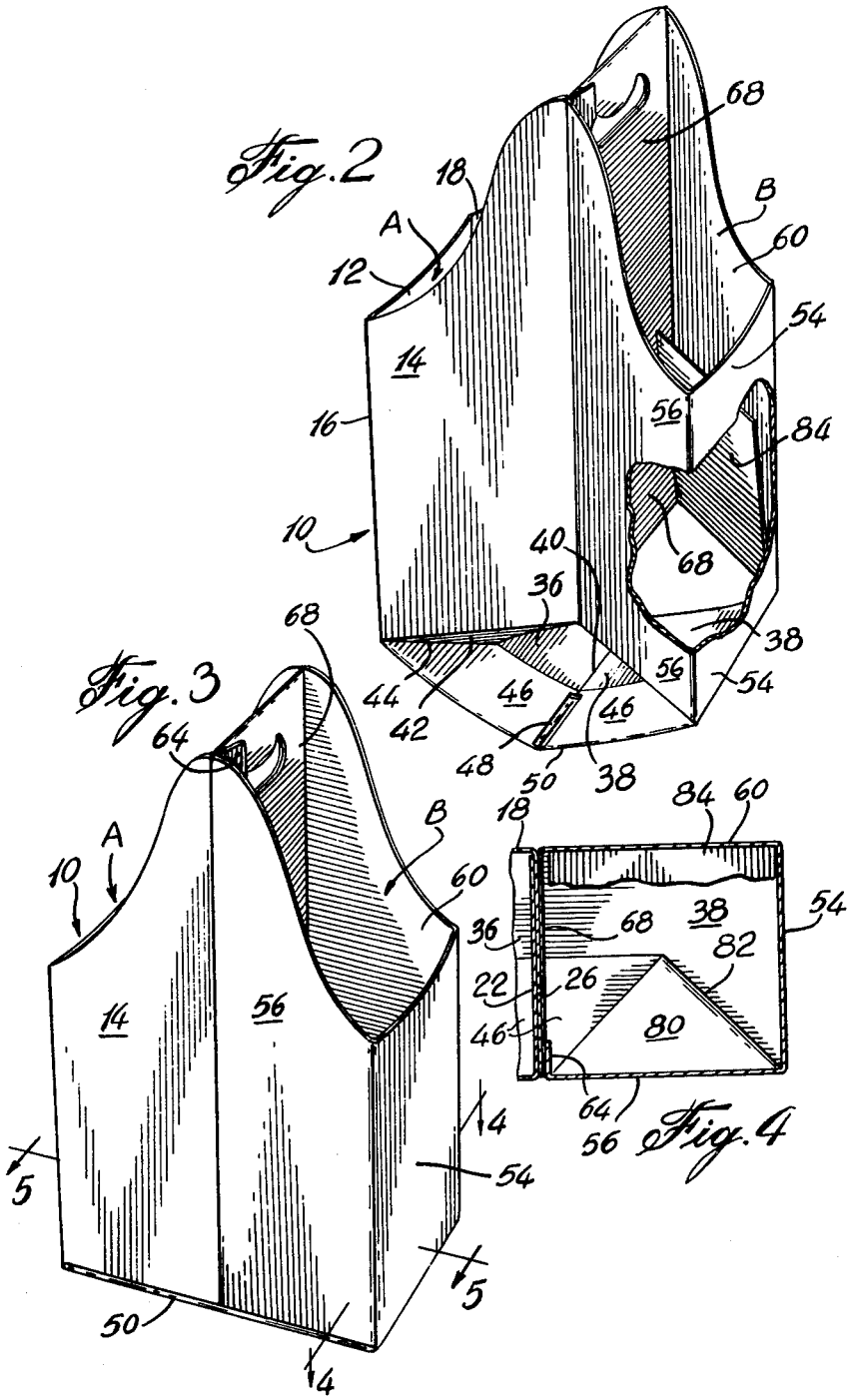
FIG. 2 is a perspective view of the carrier in the course of being erected.
FIG. 3 is a perspective view of an erected carrier made from the blank of FIG. 1.
FIG. 4 is a fragmentary horizontal cross-sectional view taken along lines IV—IV of FIG. 3.

Referring to FIGS. 3, 4 and 5, there is shown the completely erected and assembled carrier formed from the blank shown in FIG. 1. In the assembled carrier 10, the divider panels 22 and 68 sandwich divider panel 26 while the glue flap 64 is adhered near the edge of the panel 68 as shown in FIGS. 4 and 5. The glue flap 72 overlies the top of the laminated divider panels and forms a reinforcement for the handle so formed, as shown in FIGS. 2 and 3. The trapezoidal flap 46 overlies and is glued to a portion of the bottom wall panels 36 and 38 as shown in FIGS. 2, 4 and 5. The web-type triangular panels 42 and 80 along with the glued panel 46 cause the snap and locking action when erecting the carrier from its flat condition.

As in the case in these foldable type cartons, the carriers are cut and glued and assembled at the paperboard plant and are sent to the user, the bottling plant, in a collapsed flat form. When it is necessary to erect the carrier, pressure is applied in the present case along the two fold lines 16 and 58 in one direction as well as in the opposite direction along the fold lines 70 along the dividing panels. Thus, the bottom wall panels 36 and 38 as well as the web flaps 42 and 80 will spring into a flattened plane forming the bottom wall. The bottom wall therefore is made up of a single unitary continuous piece comprising panels 36 and 38. The tabs 46, 42 and 80 reinforce the bottom walls 36 and 38.

In addition, once the carrier has been erected, reinforcing flaps 52 and 84 are hinged downwardly and are made to overlay the bottom walls 36 and 38 respectively. The flaps 52 and 84 thus provide a second full bottom wall layer for supporting the beverage type containers being carried by the carrier. It is also contemplated that all of the bottom wall members can be coated with a moisture retardant.

I claim:

1. A carrier made from a one-piece blank including, when erected, a pair of cells with each cell including an end wall, a pair of opposed side walls and a dividing wall opposed to said end wall and including handle means therein; each dividing wall being adjacent and coextensive with a respective dividing wall of the other cell, the bottom walls formed by a continuous panel extending from the respective end walls of each cell and a rectangular flap connected to the bottom edge of at least one side wall in each cell to substantially overlay the bottom wall portion of the cell thereby reinforcing said bottom wall.

2. A carrier as defined in claim 1 wherein a dividing wall is of three-ply thickness with an opening provided therein for a handle and foldable board material extending from one of the dividing walls over the upper edge of the respective walls containing the handle to hold the dividing wall together.

3. A carrier as defined in claim 1 wherein a carrier is adapted to be collapsed and includes a trapezoidal flap glued to an overlying portion of the bottom wall panel connected thereto along an edge thereof, a web-like flap connected to each end edge of the trapezoidal flap and to a side wall respectively, operable to enable the erection of the carrier and to lock the carrier in an erected position and said rectangular flap connected to the bottom edge of at least one side wall in each cell overlying the portion of the trapezoidal flap and the web-like flap of each cell.

4. A carrier as defined in claim 1, 2 and 3 wherein the bottom wall panels and flaps as well as the rectangular panel overlying the bottom wall are treated with a moisture retardant.

5. A one-piece blank including a first end wall forming panel defined by a pair of parallel fold lines connected to a pair of first side wall forming panels, and at least one of the side wall panels connected to a first rectangular dividing panel including panel means cut out therein, the first end wall forming panel being connected to a rectangular bottom forming panel along a transverse edge thereof, the bottom forming panel is in turn connected to a second end panel similar to the first end panel and the second end panel is connected along parallel fold lines to respective second side panels and at least one of the side panels is connected to a further rectangular panel having handle means therein for cooperating with the first rectangular panel having handle means for forming the dividing walls between the cells, and a rectangular panel hingedly connected to at least one of each opposed side panels along the transverse edge thereof and said rectangular panel being adapted to overlay the bottom wall.

6. A one-piece blank as defined in claim 5, wherein a rectangular dividing panel is provided along each first side panel and a glue flap is provided along the other second side panel and each dividing wall panel includes an opening for forming a handle therethrough.

7. A one-piece blank as defined in claim 5, wherein there is provided a trapezoidal-shaped flap connected along a fold line of the bottom wall panel, triangular web-like panels are connected to the respective side panels along the transverse fold line and to the trapezoidal panel along a common fold line.

* * * * *